US005871423A

United States Patent [19]

Pruchnik

[11] Patent Number: 5,871,423

[45] Date of Patent: Feb. 16, 1999

[54] GYROSCOPIC WEIGHT TRAINING DEVICES

[76] Inventor: Zbigniew Pruchnik, 4940 Given Ave., Memphis, Tenn. 38122

[21] Appl. No.: 940,883

[22] Filed: Sep. 30, 1997

[51] Int. Cl.[6] ..... A63B 21/22

[52] U.S. Cl. ..... 482/110; 482/1; 482/108

[58] Field of Search ..... 482/1, 33, 106, 482/108, 109, 110

[56] References Cited

U.S. PATENT DOCUMENTS

| | | | |
|---|---|---|---|
| 3,482,835 | 12/1969 | Dean . | |
| 3,617,056 | 11/1971 | Herbold . | |
| 4,854,575 | 8/1989 | Wilson et al. . | |
| 5,180,352 | 1/1993 | Sreter . | |
| 5,476,430 | 12/1995 | Lee et al. | 482/54 |

*Primary Examiner*—John Mulcahy
*Attorney, Agent, or Firm*—Michael I. Kroll

[57] ABSTRACT

A motorized dumbbell attached to a power source for use in exercising a muscle group of a user. The motorized dumbbell includes a handle and a weight section connected thereto. The weight section includes a base connected to the handle and a skirt extending from the base to form a cup shaped recess. A cover is positioned on a side of the skirt opposite the base to close the cup shaped recess. A motor is positioned within the cup shaped recess and connected to receive power from the power source and a disk is rotatably connected to the motor wherein the disk is caused to rotate by the motor when power is applied to thereto by the power source. Movement of the motorized dumbbell when the disk is rotating produces an inertia and gyroscopic forces which act to increase the resistance applied to the muscles group being exercised by a user.

A fan is driven by the motor to draw air into the cup shaped recess through a plurality of radially extending slots in the base and direct the air to exit through a plurality of slots in the circumference of the skirt so as to provide a cooling effect to the user.

11 Claims, 3 Drawing Sheets

GYROSCOPIC WEIGHT TRAINING DEVICES

BACKGROUND OF THE INVENTION

1. Field of the Invention

The present invention relates generally to weight training devices and, more specifically, to a motorized dumbbell for creating additional tension to provide additional training for a desired muscle group.

2. Description of the Prior Art

Numerous weight training devices have been provided in the prior art. For example, U.S. Pat. Nos. 3,482,835; 3,617,056; 4,854,575; and 5,180,352 all are illustrative of such prior art While these units may be suitable for the particular purpose to which they address, they would not be as suitable for the purposes of the present invention as heretofore described.

A dumbbell or barbell with generally conventional appearance and means for manual gripping, provided however, with novel identical, uniformly rotatable unbalanced weights. Exercise is achieved by automatically resisting the centrifugal force resulting when the weights are caused to spin.

An exercising device provided which utilizes the precession effect exhibited by masses rotating at a relatively high angular velocity to resist changes in orientation of the axis of rotation. The device contains only the inertial elements which utilize a separate electric motor unit to accelerate the mass, the inertia of which provides the desired effect for several minutes after which it may again easily be accelerated for further use. The acceleration of the mass is accomplished by a clutch on the end of the electric motor shaft which is removably engageable with a rotatably mounted shaft which has the masses mounted thereon. Once the shaft and the mass has been caused to rotate at the required speed the clutch is disengaged from the rotating shaft. The shaft and the masses are rotatably mounted in a housing with a hand grip portion.

A dumbbell is provided which is collapsible for storage and/or convenient transportability and can be expanded, when required for purposes of exercising, by introduction therein of fluid such as water and sand. The dumbbell comprises a hollow, collapsible container comprising a closed loop of hollow tube having an elliptical or doughnut shape, a hollow handle traversing the gap between the inner walls of the closed loop and a fluid inlet provided with a plug seal. The outer peripheral wall of the closed loop is provided with accordion pleats biased into the closed portion but expandable against the bias under the influence of pressure generated by introduction of fluid into the container. The amount of fluid so introduced is a matter of choice of the user to achieve the desired overall weight of the device. Advantageously the dumbbells are integrally molded from thermoplastic resin.

An appliance used in exercising the arms and the legs, comprising a grip covered with a protective sleeve and fastened with an adjustable strap for use in exercising the arms, two sockets attached to said grip at two opposite ends to hold two electronic oscillators and two tapered weights, wherein said counter weights each has a bolt hole for fastening a screw rod at either end of said grip; said caps each has an annular groove for fastening a division plate to secure each electronic oscillator in place, and a tapered opening for fastening either tapered weight; said electronic oscillators are triggered to produce sounds by shock waves.

SUMMARY OF THE PRESENT INVENTION

The present invention relates generally to weight training devices and, more specifically, to a motorized dumbbell for creating additional tension to provide additional training for a desired muscle group.

A primary object of the present invention is to provide a motorized dumbbell that will overcome the shortcomings of prior art devices.

Another object of the present invention is to provide a motorized dumbbell which is able to provide additional resistance beyond gravity when movement occurs.

An additional object of the present invention is to provide a motorized dumbbell including an electric motor housed within at least one end thereof.

A further object of the present invention is to provide a motorized dumbbell which includes an air direction device for directing the a flow of air from an internal fan to cool the user.

A yet further object of the present invention is to provide a motorized dumbbell which creates tension on a muscle group being trained to thereby enhance circulation and define muscle fiber.

Another object of the present invention is to provide a motorized dumbbell that is simple and easy to use.

A still further object of the present invention is to provide a motorized dumbbell that is economical in cost to manufacture.

Additional objects of the present invention will appear as the description proceeds.

A motorized dumbbell attached to a power source for use in exercising a muscle group of a user is disclosed by the present invention. The motorized dumbbell includes a handle and a weight section connected thereto. The weight section includes a base connected to the handle and a skirt extending from the base to form a cup shaped recess. A cover is positioned on a side of the skirt opposite the base to close the cup shaped recess. A motor is positioned within the cup shaped recess and connected to receive power from the power source and a disk is rotatably connected to the motor wherein the disk is caused to rotate by the motor when power is applied to thereto by the power source. Movement of the motorized dumbbell when the disk is rotating produces an inertia and gyroscopic forces which act to increase the resistance applied to the muscle group being exercised by a user.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a front perspective view of the motorized dumbbell of the present invention including a connection for an external power source;

FIG. 1*a* is a front perspective view of the motorized dumbbell of the present invention including an internal power source;

DESCRIPTION OF THE REFERENCED NUMERALS

Figure 1:
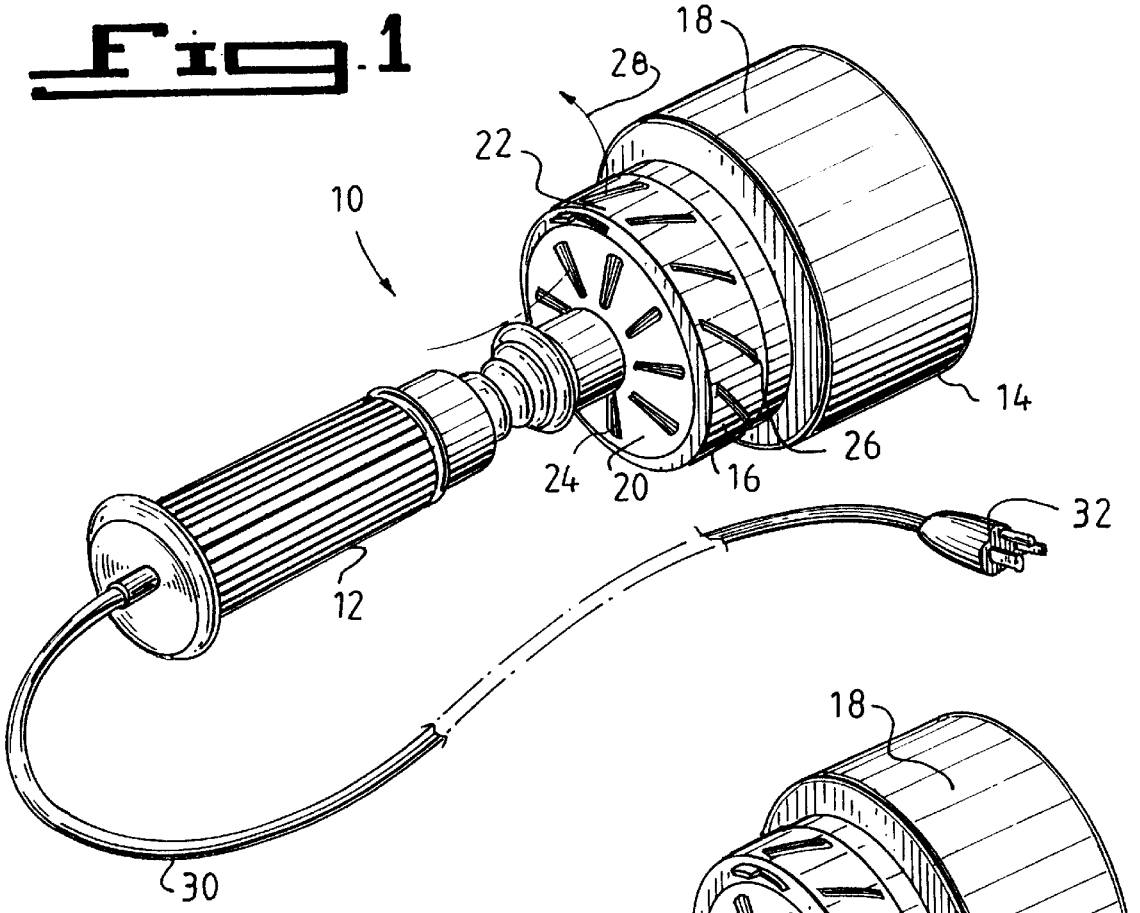

Turning now descriptively to the drawings, in which similar reference characters denote similar elements throughout the several views, the Figures illustrate motorized dumbbell of the present invention. With regard to the reference numerals used, the following numbering is used throughout the various drawing Figures.

10 motorized dumbbell of the present invention
12 handle
13 ribbed grip section of handle
14 weight section
16 motor housing
18 cover
20 base of motor housing
22 skirt extending from base of motor housing
24 radially extending slots on base
26 arcuate slots on skirt
28 arrow indicating air flow through motor housing
30 power cord
32 plug for power cord
34 internal power source
36 removable cap
38 cover of removable cap
40 skirt extending from cover of removable cap
42 thread around skirt extending from cover of removable cap
44 base of handle
46 thread extending around internal side of base of handle
48 switch on cover of removable cap
50 motor
51 fan blades
52 shaft
54 disc
56 flange
58 opposing weight section
60 motor housing of opposing weight section
62 cover for motor housing of opposing weight section
64 bolt for connecting weight section to handle
66 washer for connecting weight section to handle
68 power cord for motorized dumbbell with opposing weight sections
70 first circular rib around handle
72 second circular rib extending around opposing side of handle

DETAILED DESCRIPTION OF THE PREFERRED EMBODIMENT

Turning now descriptively to the drawings, in which similar reference characters denote similar elements throughout the several views, FIGS. 1 through 5 illustrate a motorized dumbbell indicated generally by the numeral 10.

The motorized dumbbell 10 includes a handle 12 connected to a weight section 14. The handle 12 is preferably cylindrical in shape to provide an easily gripable section for the user to hold. The handle 12 will also preferably include a ribbed outer surface 13 to further aid the user in gripping the motorized dumbbell 10. The ribbed outer surface 13 will preferably be made of rubber or any other polymeric or sponge-like material which provides a frictional, flexible spongy surface which can be easily gripped.

The weight section 14 includes a motor housing 16 and a cover 18 connected thereto. The motor housing 16 includes a base 20 and a skirt 22 extending therefrom for connecting to the cover 18. The base 20 includes radially extending slots 24 positioned around its circumference and the skirt 22 includes arcuate slots 26 extending perpendicular to the radially extending slots 24 on the base 20. The arcuate slots extend around an outer side of the skirt 22. The slots 24 and 26 allow air to flow through the motor housing 16 as indicated by the arrow labeled 28 to cool a motor contained therein. The air flow is also directed towards the user and thus provide a cooling effect.

Figure 1A:
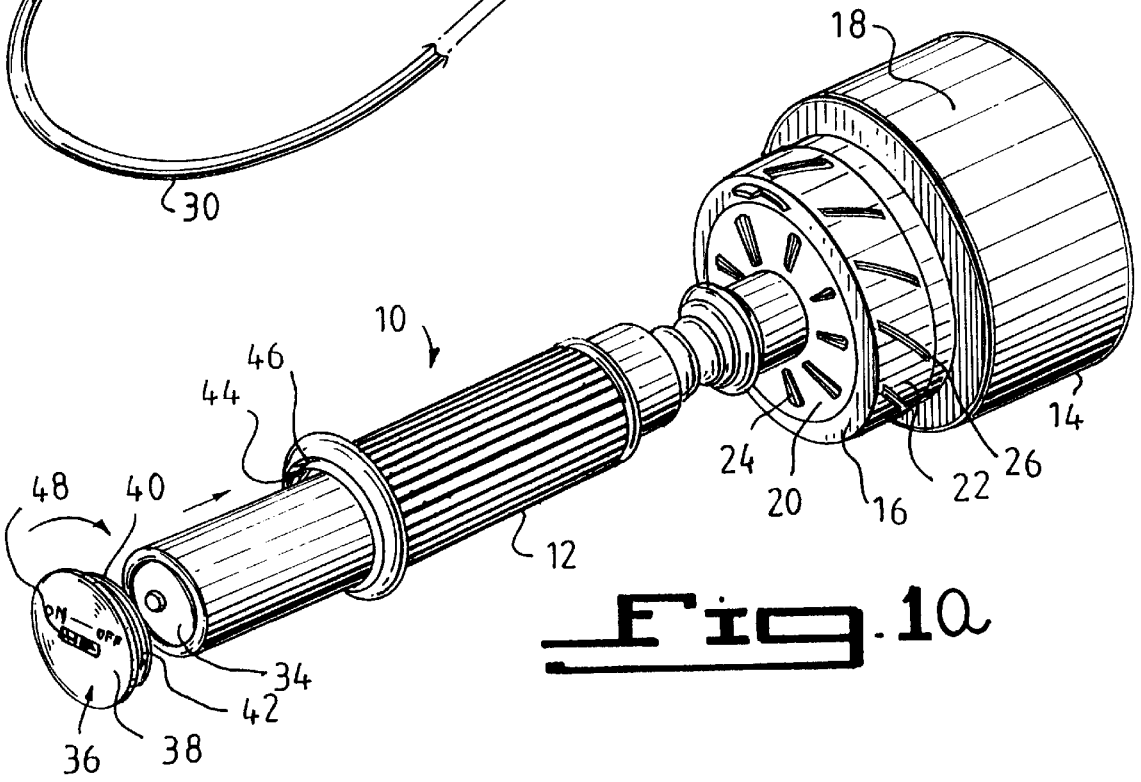

Extending from the motor housing 16 and through the handle 12 is a power cord 30 including a plug 32 connected at an end thereof for connection with an external power source (not shown). Alternatively, the motorized dumbbell 10 may include an internal power supply 34 which can be housed within the handle 12 as illustrated in FIG. 1*a*. The internal power supply 34 is removably positioned within the handle 12 and held therein by a removable cap 36. The internal power supply 34 is preferably in the form of a battery although any suitable power supply which is able to be contained within the handle 12 or handle 12 and weight section 14 of the motorized dumbbell 10 of the present invention may be used. The removable cap 36 includes a cover 38 and a skirt 40 extending therefrom, the skirt 40 including a thread 42 extending around an external side thereof. A base 44 of the handle 12 includes a thread 46 extending around an internal side thereof for mating with the thread 42 extending around the outer side of the skirt 40 and retaining the removable cover 36 attached to the handle 12 and thus retaining the internal power supply 34 therein. The removable cap 36 may also include a switch 48 for selectively connecting the internal power supply 34 to the motor contained within the motor housing 16 and thereby providing power to the motor.

Figure 2:
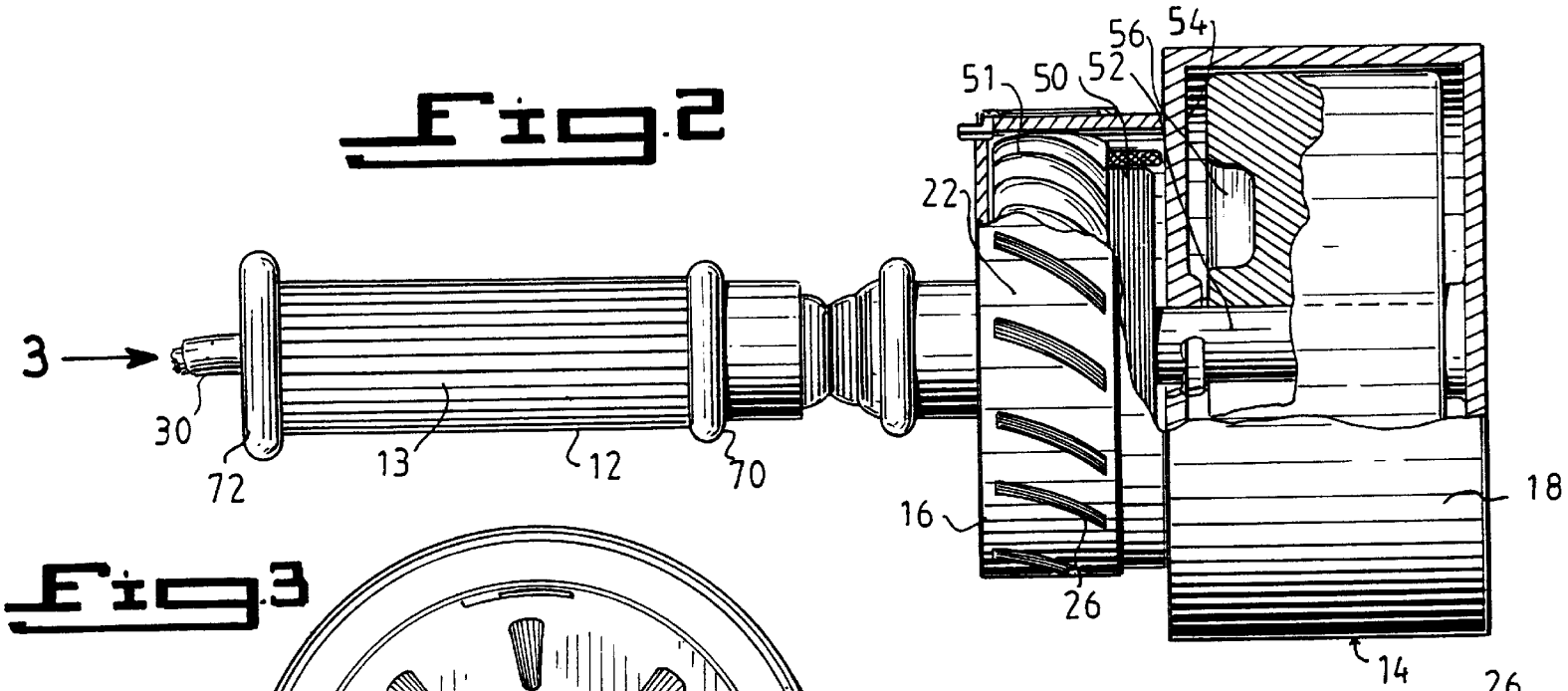
FIG. 2 is a side view in partial cross-section of the motorized dumbbell of the present invention.
Figure 3:
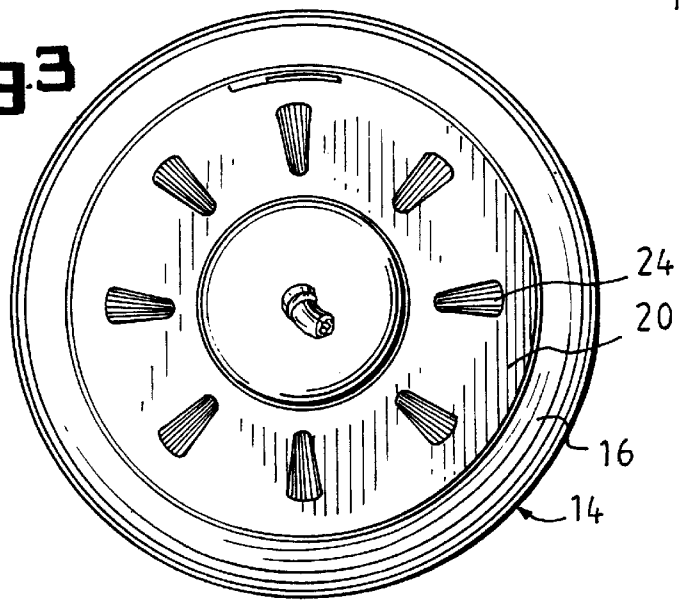
FIG. 3 is a bottom view of motorized dumbbell of the present invention taken in the direction of the arrow labeled 3 of FIG. 2.
Figure 4:
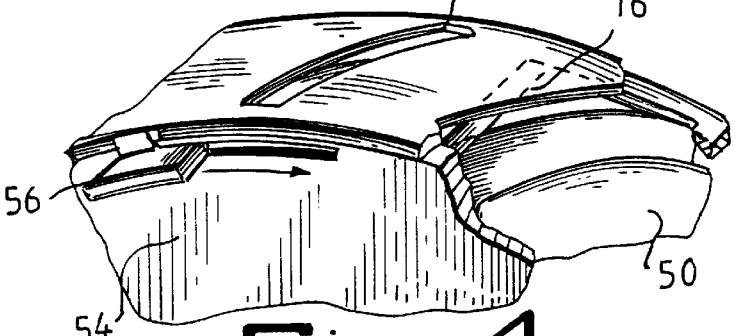
FIG. 4 is an exploded partial top view in partial cross-section and with parts cut away of the motor section of the motorized dumbbell of the present invention.

The components contained within the weight section are illustrated in FIGS. 2, 3 and 4. Positioned within the motor housing 16 is an electric motor 50. The motor 50 is powered by either the internal power source 34 or an external power source connected to the motorized dumbbell 10 by the power cord 30 and plug 32. A plurality of fan blades 51 are connected to the motor 50 and act to turn with the motor 50 to draw air into the motor, housing 16 and circulate the air therein as will be discussed hereinafter. The motor 50 is connected to turn a shaft 52 extending from the motor 50. The shaft 52 is connected to a disk 54 which rotates therewith. The motor 50 is able to rotate both the shaft 52 and the disk 54 at a rate of approximately 2000–3000 RPM's (revolutions per minute). The disk 54 includes at least one flange 56 extending from a point on an outer periphery thereof which, when rotating, causes air to be drawn into and flow through the motor housing 16. The fan blades 51 and flange 56 cause air surrounding the motorized dumbbell 10 to be drawn in through the radially extending slots 24 and circulate within the motor housing 16 as it rotates with the disk 54. The air rotating within the motor housing 16 acts to cool the motor 50 and is directed to exit the motor housing 16 via the arcuate slots 26 in the skirt 22. The angle of the arcuate slots 26 causes the air flowing therethrough to be directed towards the user and thus acts to cool the user while exercising with the motorized dumbbell 10. The flow of air into, through and out of the weight section 14 is illustrated in FIG. 1 by the arrow labeled 28.

Figure 5:
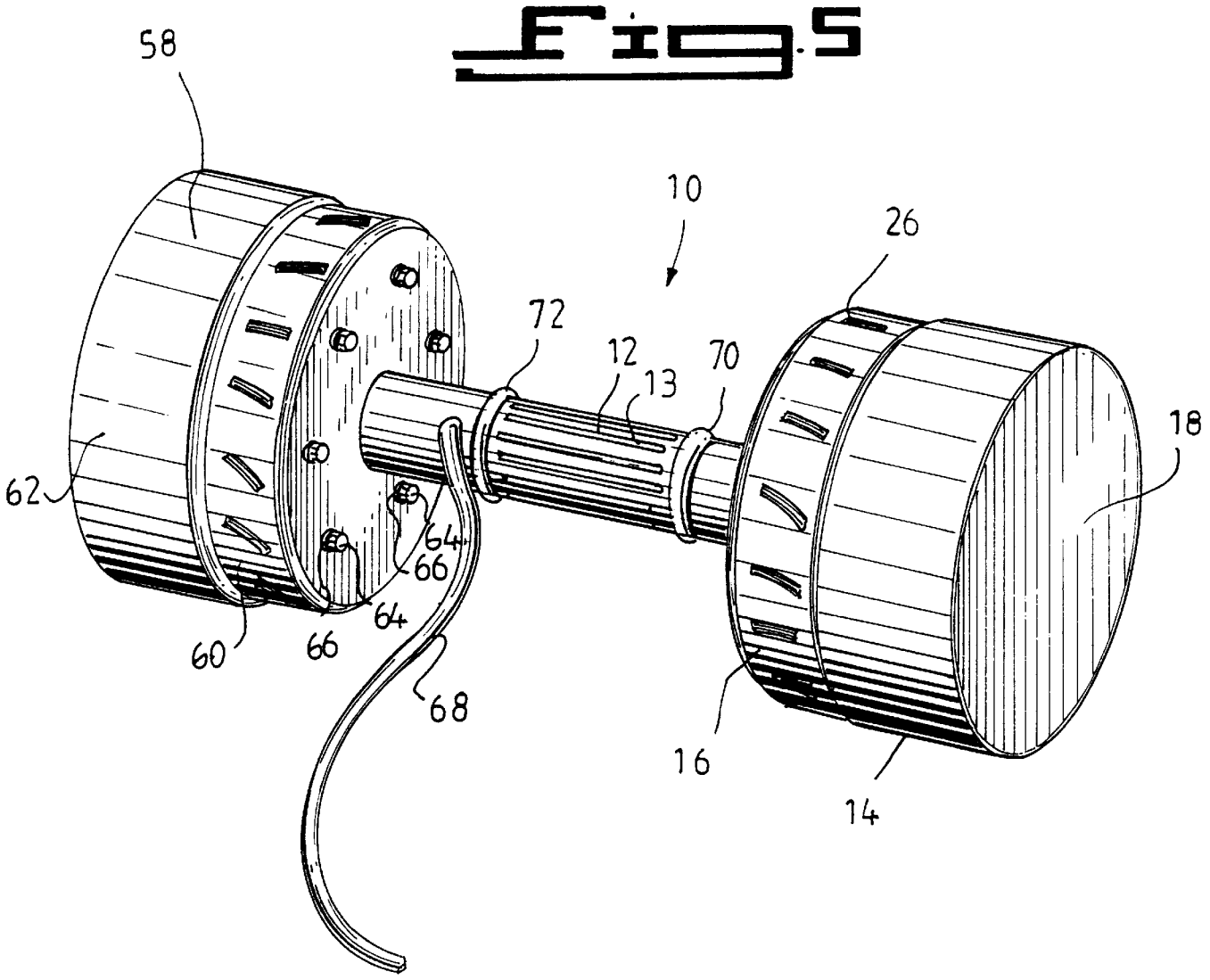
FIG. 5 is a top perspective view of the motorized dumbbell of the present invention including balanced weights on either end.

The motorized dumbbell 10 of the present invention may also include a counterbalancing weight section 58 on an opposing side thereof as is illustrated in FIG. 5. The counterbalancing weight section 58 will also include a motor housing 60 and a cover 62. The motor housing 60 will house a motor (not shown) identical to the motor 50 within the motor housing 16. As can be seen from FIG. 5 the weight section 58 will preferably be connected to the handle 12 using a bolt 64 and washer 66 combination. The weight section 14 will also be connected to the handle 12 in a similar manner. However, any method of securely attaching the weight sections 14 and 58 to opposing sides of the handle 12 may be used as long as the weight sections 14 and 58 are secured thereto and are able to be connected to the power source through the handle 12. The cover 18 and 62 of each respective weight section 14 and 58 will be connected to its respective motor housing 16 and 60 in a manner similar to the connection of the motor housing to the handle 12.

When opposing weight sections are positioned on opposite sides of the handle 12 and an external power source is used to supply power to each of the motors, the power cord 68 is connected to a position on the handle 12 adjacent one of the opposing weight sections 14 or 58. The connection of the power cord 68 is positioned so that it will not interfere with use of the motorized dumbbell 10 such as by inhibiting the ability of the user to grip the handle 12. In order to insure that the position at which the power cord 68 is connected to the handle 12 does not interfere with the gripping of the handle 12 by a user, the handle 12 may include first and second circular ribs 70 and 72 extending around opposing sides of the handle 12.

The operation of the device will now be described with reference to the figures. In operation, the motorized dumbbell 10 is connected to a power supply by connecting the power cord 30 and plug 32 to an external power supply. If an internal power supply 34 is used, the cover 36 is removed by turning the cover 36 in a counterclockwise direction to disengage the thread 42 extending around the outer side of the skirt 40 of the cover 36 from the thread 46 extending around the base 44 of the handle 12 to thus disengage the cover 36 from the handle 12. The internal battery 34 may now be positioned within the handle 12 to form an electrical connection with the motor 50. If the motorized dumbbell includes opposing weight sections 14 and 58 then the motorized dumbbell must be connected to an external power source during operation. Once the power source is connected, the motorized dumbbell 10 may be turned on by placing the switch 48 in the "ON" position thereby connecting the power source to the motor or motors.

When the motors are turned on, the fan blades 51 and shaft 52 are caused to rotate. The rotation of the shaft 52 causes the disk 54 and flange 56 thereon to turn. The turning of the fan blades 51 draws air into the motor housing 16 through the radially extending slots 24 in the base 20 thereof wherein it is circulated and directed to exit the motor housing 16 through the arcuate slots 26 in the skirt 22 thereof. The motor rotates the shaft 52 and thereby the disk 54 at a rate of approximately 2000–3000 RPM's. An inertia is caused to be formed due to the torque created by the turning disks and thus any attempt to change the position of the motorized dumbbell 10 such as by performing a curling exercise will be met with resistance due to the gyroscopic forces created.

The user will now grip the handle of the motorized dumbbell 10 over the ribbed outer surface 13 to obtain an adequate handle on the motorized dumbbell 10 and begin to exercise. The user may perform any exercise with the motorized dumbbell 10 including but not limited to curls, bench presses, inclined bench presses, overhead presses, etc. As these exercises are performed the additional resistance created by the inertia and gyroscopic forces act to increase the tension on the particular muscle group being exercised and thereby creates enhanced circulation and toning of those muscles. This provides the user with a more intensive and complete workout When the user is finished a new exercise can be performed to exercise a different muscle group. When the user is finished exercising the switch is moved to the "OFF" position and the motor is thereby disconnected from the power source.

It is to be realized that the concept of this invention is not limited to use in dumbbells but can also be applied to any other form of weights. Such other weights include but are not limited to curling bars, weight bars, individual plates, etc.

From the above description it can be seen that the motorized dumbbell of the present invention is able to overcome the shortcomings of prior art devices by providing a motorized dumbbell which is able to provide additional resistance beyond gravity when movement occurs via use of an electric motor housed within at least one end thereof. The motorized dumbbell also includes an air direction device for directing the air flow output of the fan to cool the user and creates tension on a muscle group being trained to thereby enhance circulation and define muscle fiber. Furthermore, the motorized dumbbell of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What as claimed is new and desired to be protected by Letters Patent is set forth in the appended claims:

1. A motorized dumbbell for use in exercising a muscle group of a user, said motorized dumbbell comprising a handle and a weight section connected thereto, said weight section including:

a) a base connected to said handle, said base including radially extending slots positioned therearound;

b) a skirt extending from said base to form a cup shaped recess, said skirt having a circumference and a length and including a plurality of slots extending around the circumference and along the length thereof;

c) a cover positioned on a side of said skirt opposite said base;

d) a motor positioned within said cup shaped recess and connected to receive power from a power source;

e) a disk rotatably connected to said motor wherein said disk is caused to rotate by said motor when power is applied to said motor by said power source wherein movement of said motorized dumbbell when said disk is rotating produces an inertia and gyroscopic forces acting to increase the resistance applied to a muscle group being exercised; and f) a fan positioned within said cup shaped recess and rotatably connected to said motor, wherein said fan is caused to rotate by said motor when power is applied thereto by said power source such that said fan acts to draw air into said cup shaped recess through said plurality of radially extending slots and direct said air to exit said cup shaped recess through said plurality of slots in said skirt for providing a cooling effect to a user.

2. The motorized dumbbell as recited in claim 1, wherein said fan includes a plurality of fan blades for use in drawing in and directing said air.

3. The motorized dumbbell as recited in claim 2, wherein said disk further includes a flange extending therefrom for circulating said air drawn in by said fan around said cup shaped recess and provide a cooling effect to said motor.

4. The motorized dumbbell as recited in claim 1, wherein said handle includes a plurality of ribs extending therearound for use in gripping said handle by a user.

5. The motorized dumbbell as recited in claim 4, wherein said plurality of ribs are made of a material selected from the group consisting of rubber, polymeric material and sponge-like material.

6. The motorized dumbbell as recited in claim 1, wherein the power source is located external to the motorized dumbbell and further comprising a power cord connected to said motor for connection with the external power source.

7. The motorized dumbbell as recited in claim 1, wherein said handle is cylindrical in shape and said power source is located within said handle.

8. A motorized dumbbell for use in exercising a muscle group of a user, said motorized dumbbell comprising a handle and a weight section connected thereto, wherein said weight section includes first and second weight portions, each of said weight portions including:

a) a base connected to said handle, said base including radially extending slots positioned therearound;

b) a skirt extending from said base to form a cup shaped recess, said skirt having a circumference and a length and including a plurality of slots extending around the circumference and along the length thereof;

c) a cover positioned on a side of said skirt opposite said base;

d) a motor positioned within said cup shaped recess and connected to receive power from a power source;

e) a disk rotatably connected to said motor wherein said disk is caused to rotate by said motor when power is applied to said motor by said power source wherein movement of said motorized dumbbell when said disk is rotating produces an inertia and gyroscopic forces acting to increase the resistance applied to a muscle group being exercised by a user; and f) a fan positioned within said cup shaped recess and rotatably connected to said motor, wherein said fan is caused to rotate by said motor when power is applied thereto by said power source such that said fan acts to draw air into said cup shaped recess through said plurality of radially extending slots and direct said air to exit said cup shaped recess through said plurality of slots in said skirt for providing a cooling effect to a user.

9. The motorized dumbbell as recited in claim 8, wherein said fan includes a plurality of fan blades for use in drawing in and directing said air.

10. The motorized dumbbell as recited in claim 9, wherein said disk further includes a flange extending therefrom for circulating said drawn in air around said cup shaped recess and provide a cooling effect to said motor.

11. The motorized dumbbell as recited in claim 8, wherein said handle includes a plurality of ribs extending therearound for use in gripping said handle by a user.

* * * * *